United States Patent [19]

Schmolke

[11] Patent Number: 4,612,084

[45] Date of Patent: Sep. 16, 1986

[54] METHOD FOR TREATING THE EDGES OF A SAWTOOTH WIRE FOR THE CARD CLOTHING OF TEXTILE MACHINES

[75] Inventor: Karl-Heinz Schmolke, Neuweiler, Fed. Rep. of Germany

[73] Assignee: Hollingsworth GmbH, Neubulach, Fed. Rep. of Germany

[21] Appl. No.: 646,560

[22] Filed: Aug. 31, 1984

[30] Foreign Application Priority Data

Sep. 12, 1983 [DE] Fed. Rep. of Germany ..... 3332804

[51] Int. Cl.[4] ..... C23F 1/02; B44C 1/22

[52] U.S. Cl. ..... 156/639; 156/645; 156/656; 156/659.1; 156/345

[58] Field of Search ..... 156/639, 645, 654, 656, 156/659.1, 644, 345; 134/3, 15, 41; 204/129.1, 129.35, 129.55, 129.65; 19/98-104, 114

[56] References Cited

U.S. PATENT DOCUMENTS

| | | | |
|---|---|---|---|
| 2,052,962 | 9/1936 | Booe | 156/665 X |
| 3,580,737 | 5/1971 | Traynor | 156/665 X |
| 3,719,536 | 3/1973 | Rheingold et al. | 156/639 |

*Primary Examiner*—William A. Powell
*Attorney, Agent, or Firm*—Cort Flint

[57] ABSTRACT

The edges of a sawtooth wire used for card clothing of rollers and covers in textile machines are deburred by chemical or electrochemical means in order to prevent fibres from adhering to the card clothing. The bearing areas of the saw teeth are protected from excessive rounding by contact with a plastic or metal component. The tips of the teeth of the sawtooth wire may be protected from deburring.

9 Claims, 3 Drawing Figures

METHOD FOR TREATING THE EDGES OF A SAWTOOTH WIRE FOR THE CARD CLOTHING OF TEXTILE MACHINES

BACKGROUND OF THE INVENTION

The invention relates to a method for treating the edges of a sawtooth wire for the card clothing of rollers and carding flats in textile machines.

Sawtooth wires are mainly used as clothing in carding machines, scribbler cards, random cards, openers and cleaning devices, centrifugal cards, opening rollers for open-end spinning machines, opening rollers for friction spinning frames, as well as in stationary carding flats, distributing devices and smoothing devices.

In such kind of apparatusses, the treated fibre material must be transferred from a feeder or roller to the next treatment station and must be treated in a distinct way. To achieve this, it is extremely important that the sawtooth wire clothing is adapted to release the fibre material rapidly and completely and to avoid that fibres adhere to the clothing wire. This applies particularly to opening rollers for open-end spinning machines and friction spinning frames as well as for rollers in random cards and centrifugal cards.

It has been found that the aforementioned objects may be achieved by rounding off the edges of the sawtooth wire clothing, particularly in the region of the front faces of the teeth.

According to a well-known method, a sawtooth wire having punched-out teeth is sand-blasted so as to round the sharp edges of the teeth. It has, however, been found that this kind of treatment of the sawtooth wire leads to a rough surface of the teeth, so that fibres tend to adhere to the same and to clodge the clothing. Also, the points or tips of the teeth are excessively rounded, resulting in an impairment of the carding efficiency of the teeth.

BRIEF SUMMARY OF THE INVENTION

It is an object of the invention to provide a method, by which the edges of the teeth of a sawtooth wire are contoured such that the sawtooth wire clothing has an excellent carding and transporting action and easily releases the individual fibres, thus avoiding the clodging of the clothing.

The aforementioned objects are achieved by chemically deburring this sawtooth wire. Chemical deburring is particularly advantageous for the treatment of sawtooth wires made of alloyed or plain carbon steels. The term "chemical deburring" shall encompass also "electrochemical deburring".

Electrochemical deburring is particularly suitable for the treatment of stainless steel or any other high-alloyed steel such as chrome-nickel steel.

The treatment may be continued until the radius of curvature of the edges has reached a desired amount, and the maximum radius may correspond to half the width of the teeth, so that the front edges of the teeth are rounded to a semicircular cross-sectional contour.

In an advantageous further development the tips of the sawtooth wire are kept in contact with an inert protective medium for at least part of the duration of the treatment. Such inert protective medium is intended to resist attacked by the solution used in the treatment process.

The protective medium may preferably be a resilient plastic material. Contact between the tips of the teeth of the sawtooth wire and the plastic element prevent the tips from being chemically or electrochemically treated. By this, the tips remain sharp, whereas the front edges of the teeth of the sawtooth wire are rounded.

When the sawtooth wire is treated electrochemically, the protective medium may be a metal part. As long as the tips are in contact with said metal part, there is no potential difference there between and no concentration of field lines at the tips, so that the same are not electrochemically treated.

In either case it is preferable to keep the teeth in contact with the protective medium during the final part of the treatment. Thus, any burrs left after punching will be removed from the teeth before these come into contact with the protective medium or part, so that the same will not be damaged.

BRIEF DESCRIPTION OF THE DRAWINGS

The invention will hereinafter be described in the following description and by reference of the accompanying drawings forming a part thereof, wherein an embodiment of the invention is shown and wherein.

DETAILED DESCRIPTION OF A PREFERRED EMBODIMENT

To treat a sawtooth wire, it is first treated for one minute at a temperature of 60° C. with a standard degreasing agent such as MGL 110 degreasant. The principal ingredients of this degreasing agent are caustic soda, phosphate, emulsifiers and a wetting agent, dissolved in water. Thereafter the sawtooth wire is pickled for four minutes at a temperature of 40° C. in a solution of sulphuric acid and 10% MGL 95 caustic degreasant containing iron inhibitors and substances to prevent hydrogen embrittlement.

Figure 1:
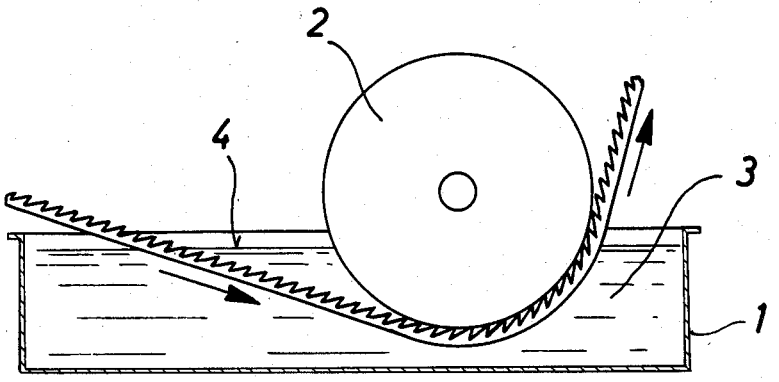
FIG. 1 shows a longitudinal section through a device for executing the process.

The sawtooth wire is then led through the treatment device shown in FIG. 1, which includes a tank 1 and a roller 2 made of an inert material, for example a plastic roller. The tank is filled with a standard chemical deburring agent 3 such as is sold under the trade name "Achat" by Metallglanz Co. of Mühlacker near Pforzheim or "Carbochem" of Poligrad Co. of Munich. The principal ingredients of such deburring agents are fluoride and peroxide dissolved in water. As it passes through the treatment device of FIG. 1, the sawtooth wire is initially completely surrounded by the treatment solution, so that all the burrs are removed from the sawtooth wire. The points or tips of the sawtooth wire are then brought into contact with the plastic roller 2 such that the tips are protected from the treatment solution and are not further eroded. The sawtooth wire is not released from the roller 2 unless it is above the surface level of the bath.

Figure 2:
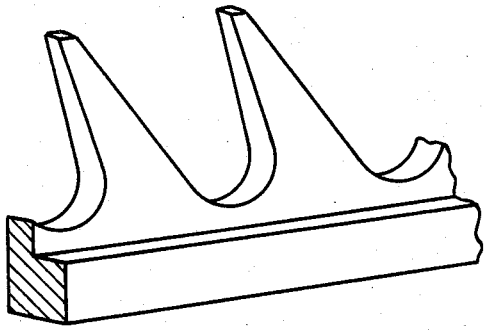
FIG. 2 shows a portion of the sawtooth wire before treatment.
Figure 3:
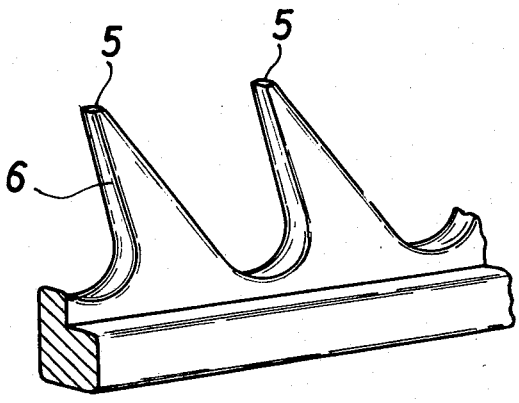
FIG. 3 shows a portion of the sawtooth wire after treatment.

Upon entering the treatment device the teeth of the sawtooth wire are shaped as shown in FIG. 2. It will be seen that the teeth still have sharp edges, a result of the method of manufacture, usually punching out.

After leaving the treatment device the edges of the saw teeth are rounded to a lower extent in the region of the tips 5 of the teeth than in the area of the front faces 6, since the tips were in contact with the treatment liquid only during part of the treatment time for being in contact with the resilient plastic roller 2. This results in a relatively large rounding of the edges of the front faces 6 and but a little change in the shape of the tips 5.

Although any sharp edges of the sawtooth wire are affected by the treatment, this does not adversely affect the operational performance of the sawtooth wire.

After leaving the treatment device shown in FIG. 1, the sawtooth wire is pickled in a 3% sulphuric acid solution for four minutes at room temperature in order to stabilize the surface of the metal, and is then neutralized in a neutralizing agent such as Neutralon® at 50° C. for one minute. Thereafter, in order to prevent rust formation during storage, the sawtooth wire may be lightly greased for one minute at room temperature with a greasing agent such as MGL 317, which principally consists of an agent containing wax, dissolved in petrol.

The sequence of operations may be carried out either as one continuous process or as a batch process.

Alternatively, deburring may also be done electrochemically, the effect of the concentration of lines of force on the sharp edges of the sawtooth wire being that these edges are eroded and rounded to a greater degree. Also, in carrying out this process, which is particularly suitable for high-alloyed steels such as chrome-nickel steel, the tips may be protected from too high a degree of rounding by using a device such as that depicted in FIG. 1.

In place of the plastic roller, for example, a metal roller or a metal disc may be used, which prevents a concentration of lines of force in the area of the tips of the saw teeth, although a non-conductive roller such as the plastic roller shown in FIG. 1 is preferable.

I claim:

1. A method of reducing the adherence of fibers to the teeth of sawtooth wire in textile machinery by treating edges of the teeth in a manner that sharp edge of the teeth are rounded wherein the improvement comprises treating the teeth of said sawtooth wire by subjecting said sawtooth wire to a chemical deburring bath wherein sharp edges of said teeth are rounded by chemical deburring.

2. The method of claim 1 including subjecting said sawtooth wire to said chemical deburring until the edges of said teeth have reached a desired radius of curvature.

3. The method of claim 1 including maintaining the tips of the teeth of said sawtooth wire in contact with an inert protective medium for at least part of the duration of the chemical deburring treatment in a manner that the tips of said teeth are rounded to a lesser extent than said edges of said teeth so that tips remain sharp for effective carding action while the front edges of the teeth are rounded to reduce adherence of fibers and facilitate quick release of said fibers.

4. The method of claim 3 including providing said inert protective medium in the form of a resilient plastic component.

5. The method of claim 3 including exposing said tips of said teeth of the sawtooth wire for an initial portion of said chemical deburring treatment and maintaining said teeth in contact with said protective medium during a final portion of said treatment.

6. The method of claim 3 wherein the inert protective medium is a metal component.

7. the method of claim 1 including maintaining the tips of said teeth of sawtooth wire in contact with a plastic resilient surface of a roller in which said tips become partially embedded to prevent chemical deburring of said tip during a final portion of said treatment in a manner that tips are less rounded than front edges of said teeth for effective carding while reduced adherence and quick release of fibers at said front edges is provided.

8. A method for treating the teeth of sawtooth wire used in textile processes comprising passing sawtooth wire through a chemical deburring bath wherein said teeth are chemically deburring and contacting the tips of said wire teeth with an inert protective medium for at least part of the duration of said sawtooth wire passing through said chemical bath in a manner that the tips of said teeth are rounded to a lesser extent than the front edges of said teeth so that tips of said teeth are deburring but remain sharp for effective grasping of fibers while front edges of said teeth are deburred and more rounded for quick release and reduced adherence of fibers.

9. The method of claims 8 including maintaining the tips of said teeth of said sawtooth wire in contact with said inert protective medium by bringing said teeth into contact with a roller having a resilient plastic surface in a manner that said tips of said teeth become slightly embedded in said plastic material during at least part of the duration of said sawtooth wire passing through said chemical bath.

* * * * *